US005417333A

United States Patent [19]

Flum

[11] Patent Number: 5,417,333

[45] Date of Patent: May 23, 1995

[54] GRAVITY FEED DISPLAY UNIT WITH MODULAR CAPABILITY

[75] Inventor: Paul L. Flum, St. Louis, Mo.

[73] Assignee: Paul Flum Ideas, Inc., St. Louis, Mo.

[21] Appl. No.: 82,038

[22] Filed: Jun. 24, 1993

[51] Int. Cl.[6] ..... A47F 5/00

[52] U.S. Cl. ..... 211/59.2; 211/194

[58] Field of Search ..... 211/59.2, 194, 188, 211/133

[56] References Cited

U.S. PATENT DOCUMENTS

| | | | |
|---|---|---|---|
| 4,454,949 | 6/1984 | Flum | 211/59.2 |
| 4,621,740 | 11/1986 | Lang | 211/194 X |
| 4,763,796 | 8/1988 | Flum | 211/59.2 |
| 4,901,872 | 2/1990 | Lang | 211/194 X |
| 4,930,643 | 6/1990 | Flum | 211/194 X |
| 4,940,150 | 7/1990 | Spengler | 211/194 X |
| 4,953,719 | 9/1990 | Spamer | 211/188 |
| 4,982,849 | 1/1991 | Flum et al. | 211/59.2 |

*Primary Examiner*—Alvin C. Chin-Shue
*Assistant Examiner*—Sarah L. Purol
*Attorney, Agent, or Firm*—Haverstock, Garrett & Roberts

[57] ABSTRACT

A gravity feed display unit capable of being both vertically and horizontally arranged to achieve a wide variety of modular gravity feed configurations comprising a plurality of shelf members each having opposed side wall portions and a planar floor portion extending therebetween dividing each shelf member into respective upper and lower portions, a plurality of socket cavities integrally formed with the respective upper and lower portions of each of the shelf members, the shelf socket cavities being positioned at spaced locations adjacent the opposed side wall portions of each respective shelf member and each socket cavity including angularly oriented side wall portions, a plurality of elongated support members each having opposed end portions adapted to be insertably receivable within each of the shelf socket cavities so as to connect adjacent shelf members in spaced apart relationship one above the other, the planar floor portion of each shelf member being angularly oriented relative to a horizontal surface in a gravity feed orientation when a plurality of the support members are engaged with the upper and lower socket cavities of adjacent shelf members and the connected support members are thereafter vertically oriented relative to the same horizontal surface. A connector member is likewise disclosed for joining at least two of the present shelf members in a side-by-side gravity feed relationship one adjacent the other, use of a plurality of the present connector members enabling vertically disposed adjacent shelf members to be connected both in spaced apart gravity feed relationship one above the other and in side-by-side gravity feed relationship one adjacent the other.

15 Claims, 6 Drawing Sheets

GRAVITY FEED DISPLAY UNIT WITH MODULAR CAPABILITY

The present invention relates generally to product display devices for use in storing and merchandising shelved products and, more particularly, to a display unit construction which can be both stackably arranged in an inclined gravity feed orientation to achieve any desired number of vertically disposed gravity feed oriented shelf members and which can likewise be horizontally arranged to achieve any side-by-side gravity feed modular configuration. The present display unit includes a plurality of shelf members each having a substantially planar horizontal display area or floor portion for storing and merchandising products thereon, and, importantly, each includes improved socket means located at spaced locations adjacent the opposed side portions of each shelf member, the improved socket means each including means for automatically angularly orienting each respective shelf member to a gravity feed orientation when a plurality of upright support members are cooperatively engaged therewith. The present shelf members not only provide improved stability and rigidity when a plurality of such shelf members are stackably arranged in spaced relationship one above the other in parallel inclined gravity feed orientation, but such shelf construction also greatly enhances the modular capability of a display unit utilizing the present shelf members and provides a greater degree of flexibility in using and orientating the present display unit in any particular merchandising area. The present display unit is particularly adaptable for use in many display shelf applications and can be utilized for displaying and merchandising a wide variety of products such as soft drink products, fruit juice products, dairy products, yogurt, beer, liquor and other types of packaged and/or canned products including other types of beverage products.

BACKGROUND OF THE INVENTION

Many different types of gravity feed devices and systems including a variety of different means for converting non-gravity feed display devices to gravity feed systems have been designed and manufactured for use in merchandising shelved products to consumers. Such known gravity feed devices and systems teach a wide variety of constructions including modular constructions which permit the vertical stacking of one shelf member above the other as well as other types of multi-tiered and multiple shelf constructions. Typical of such prior art constructions are those devices and units disclosed in the background of the invention section of U.S. Pat. Nos. 4,763,796, 4,953,719, 4,982,849, 4,763,796 and 4,982,849 having been issued to the present Assignee.

Despite the known prior art devices, there still exists a requirement in the industry to fill certain important needs in gravity merchandising products to consumers, particularly when it comes to merchandising consumer products in all kinds of retail stores such as supermarkets, convenience stores and the like. This is particularly true when it comes to providing free-standing gravity merchandisers in supermarkets and when it comes to gravity merchandising all kinds of products in refrigerated display cases and other types of display coolers and cold vaults commonly used in convenience stores where a multi-shelf construction is necessary behind each cooler or cold vault door for displaying a multiplicity of products in different package and container sizes. Although much has already been achieved regarding gravity merchandising products in convenience store refrigerated coolers and/or cold vaults, and although much of this achievement has been accomplished by the various product lines of the present Assignee, there still remains a vital need for free-standing multi-shelf gravity display merchandisers which include their own means for vertically stackably arranging and supporting one shelf member above the other in a gravity feed orientation as compared to utilizing and/or modifying existing shelving commonly associated with the known refrigerated display cases and other display units and systems.

There is also an especially great need to fulfill the above-referenced needs with a lower cost unit such as manufacturing gravity display merchandisers out of lighter weight materials such as plastic as opposed to the present combination of horizontal metal shelves with vertical metal supports presently used in many refrigerated coolers and/or cold vaults, which metal shelving and support structures must then be transformed by plastic add-on shelves to achieve the desired gravity feed feature, namely, the "automatic fronting" of products to consumers. The automatic gravity feed feature of display merchandisers demonstratively increases sales in such environments. The present gravity feed display unit is specifically designed to meet all of the aforementioned needs.

More particularly, the present gravity feed construction represents an improvement over the known gravity feed devices including those devices disclosed and illustrated in U.S. Pat. Nos. 4,763,796; 4,953,719; and 4,982,849. As compared to the above-referenced prior art devices and systems, the present gravity feed construction provides improved stability and strength when stackably arranged and it substantially reduces racking, swaying or other movement depending upon the weight and load distribution of the particular products positioned thereon. The present construction also affords greater and improved modular capability as compared to the known prior art gravity feed devices. The present shelving units as well as the improved means for both vertically stacking such units in spaced relationship one above the other in a gravity feed orientation and for horizontally arranging the same to achieve any side-by-side gravity feed modular configuration is clearly different from and distinguishable over the above known prior art constructions.

SUMMARY OF THE INVENTION

The present gravity feed display devices overcome many of the disadvantages and shortcomings associated with the known constructions and teach the construction and operation of a gravity feed display unit which includes a plurality of similar shelf members and a plurality of elongated support members, the elongated support members being cooperatively engageable with improved socket means located on both the upper and lower portions of each respective shelf member. The present socket means are integrally formed into each respective shelf member located adjacent the opposed side wall portions thereof and each socket means includes a cavity adaptable for receiving a correspondingly shaped end portion associated with each respective support member. Each socket cavity is angularly positioned at the same acute angle relative to the plane of each shelf floor portion such that when the elongated support members are engaged therewith and the assembled unit is supported on a substantially horizontal support surface, the floor portion of each individual shelf member will be supported in an inclined gravity feed position. This means that products positioned on each respective shelf member will automatically slide along the floor portion associated respectively therewith towards the front of the unit to provide a convenient, continuous supply of products within easy reach of consumers. Although it is preferable that the socket means associated with the upper portion of each shelf member be axially positioned in alignment with the socket means associated with the lower portion of each shelf member, this is not a requirement of the present invention and such upper and lower socket means can be arranged in a non-aligned orientation with respect to each other and still achieve the benefits and objectives of the present invention.

The elongated support members may be fabricated into any desirable shape so long as the corresponding socket means associated with each respective shelf member are likewise correspondingly shaped and dimensioned so as to cooperatively receive either end portion of each respective support member. In this regard, the elongated support members are used to arrange and support the respective shelf members in spaced apart relationship one above the other so as to achieve a vertically disposed gravity feed oriented display system. When the support members are properly positioned and engaged with the improved socket means associated with a first shelf member, a second shelf member may be vertically stackably arranged thereupon in position to receive another plurality of support members, if so desired. This stacking process may be continued to achieve any desired number of vertically disposed shelf members and/or any desired display height.

Other embodiments of the present shelf member include any number of socket means arranged and positioned adjacent the opposed side portions of each respective shelf member, the particular number of such plurality of socket means being dependent upon the degree of expanded capability desired as will be hereinafter explained. The plurality of socket means associated with each side portion of the respective shelf members are preferably arranged in a linearly aligned array, the spacing between each respective socket means being subject to change depending upon the particular application desired. This particular arrangement of socket means provides greater capability in that it allows a user to strategically position the upright support members inwardly from the respective corners of each shelf member so as to improve product visibility and customer accessibility. Also, this particular arrangement of socket means contributes greatly and significantly expands the modular capability of such shelf members as will be hereinafter further described.

The modular capability of the present display unit is achieved through the use of a substantially Y-shaped connector means having a double socket arrangement associated with one end portion thereof and a single socket arrangement associated with its opposite end portion. Each of the sockets associated with the present Y-shaped connector includes a cavity, the cavity associated with the single socket portion being correspondingly shaped and dimensioned to receive either end portion of the respective support members whereas each of the cavities associated with the double socket portion is corresponding shaped and dimensioned to be insertably received into any one of the improved socket means located on either the upper or lower portion of each respective shelf member. Importantly, the present Y-shaped connector means is specifically configured so as to impart the same angular inclination to the present shelf members when such shelf members are properly engaged therewith. Proper use and arrangement of the present Y-shaped connector means in association with the present shelf members and support members enables a plurality of such units to be easily joined together in a multiplicity of side-by-side gravity feed modular arrangements, including various offset and/or staggered arrangements so as to form a structurally integral and unitized system. This provides greater flexibility in using and orientating the present display unit in any particular merchandising area and allows a user to modularly arrange such units accordingly as will be hereinafter explained.

All of the features and capabilities afforded by the present shelf members and modular display unit formed therefrom are particularly important to merchants because they enhance the accessibility to the customer of any products displayed therein; they provide a merchant with a greater range of possibilities for utilizing a gravity feed type arrangement when displaying goods for sale to customers; and they provide a merchant with a greater range of possiblities for maximizing adjacent positioning of a plurality of such units by providing a multitude of alternative modular configurations.

It is therefore a principal object of the present invention to provide an easy to assemble gravity feed display unit.

Another object is to provide a gravity feed display system which affords a user several different options when determining how best to display and arrange the sale of a wide variety of products therefrom.

Another object is to provide improved means for vertically stackably arranging a plurality of shelf members in spaced relationship one above the other in a gravity feed orientation.

Another object is to provide a gravity feed display unit having means associated therewith for modularly arranging and connecting such units in a wide variety of adjacent side-by-side gravity feed configurations.

Another object is to provide a gravity feed display unit which maximizes adjacent positioning of a plurality of such units.

Another object is to provide an improved modular-type gravity feed display unit having greater functionality, versatility and utility for merchandising, displaying and storing a wide variety of shelved products.

Another object is to provide an improved shelf member for use with modular gravity feed display devices.

Another object is to provide an improved shelf member which utilizes any plurality of socket means arranged in arrays associated with its respective side portions for enhancing product visibility and accessibility as well as its modular capability.

Another object is to provide an improved shelf member which is adaptable to be compatible with a wide variety of existing modular display units.

These and other objects and advantages of the present invention will become apparent to those skilled in the art after considering the following detailed specification in conjunction with the accompanying drawings wherein:

Figure 8:
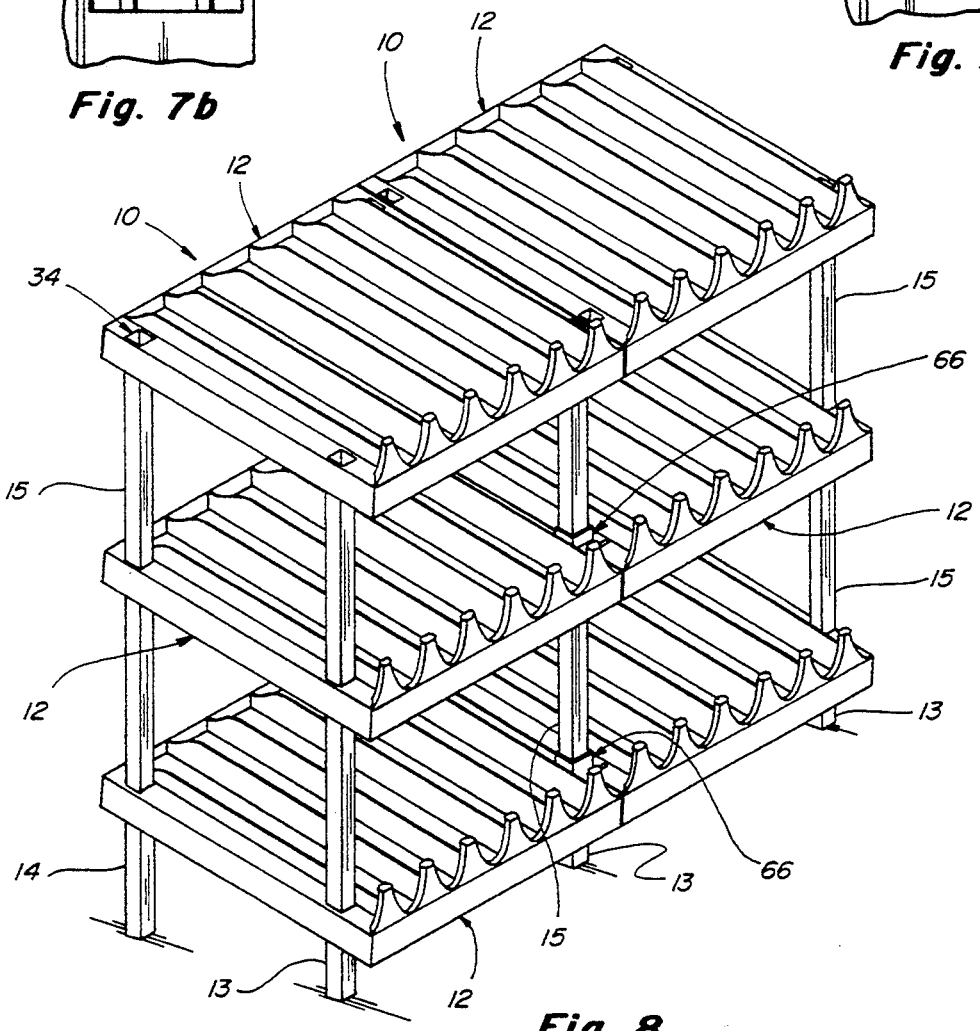
Figure 9:
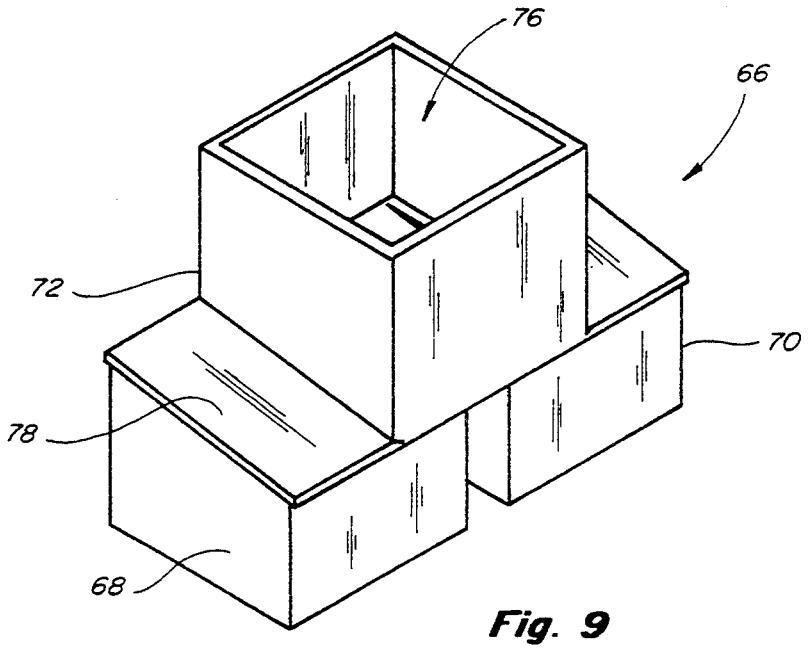
Figure 10:
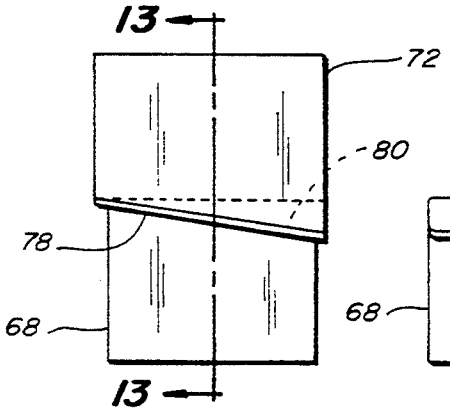
Figure 11:
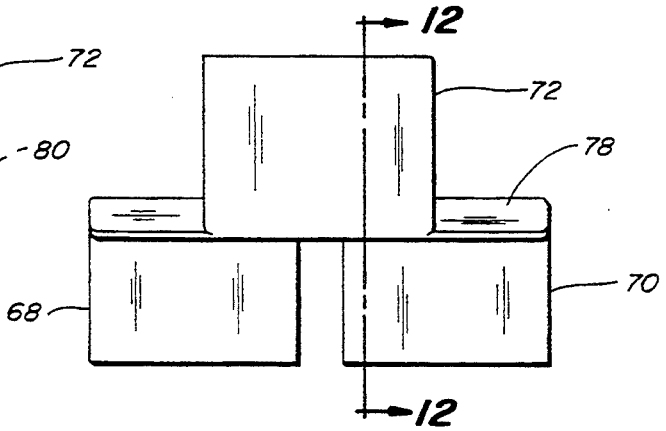
Figure 12:
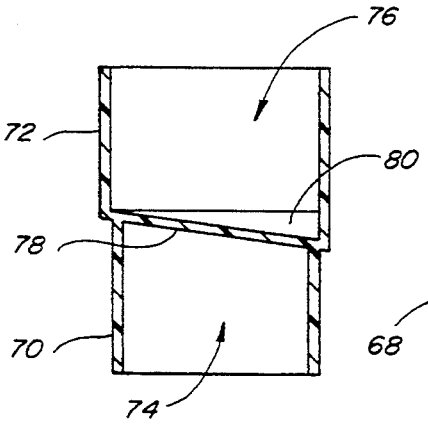
Figure 13:
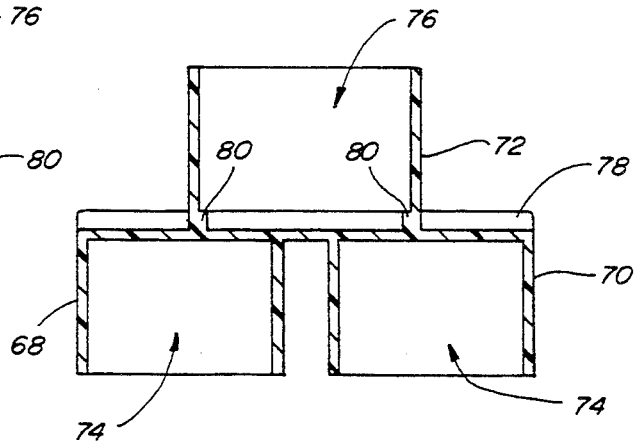
Figure 14:
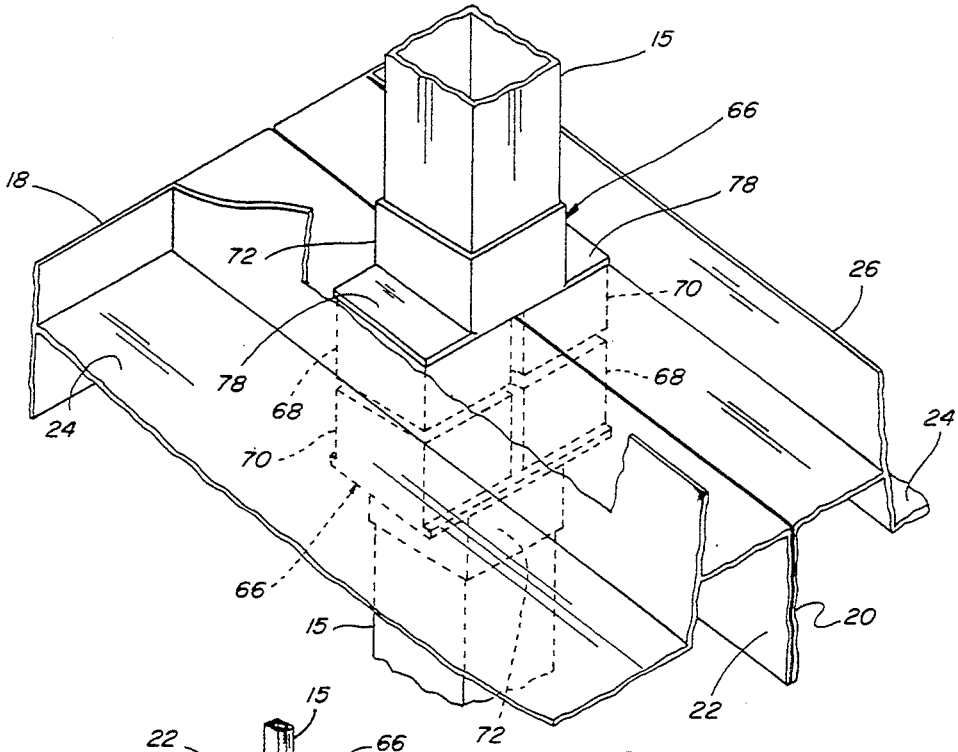
Figure 17:
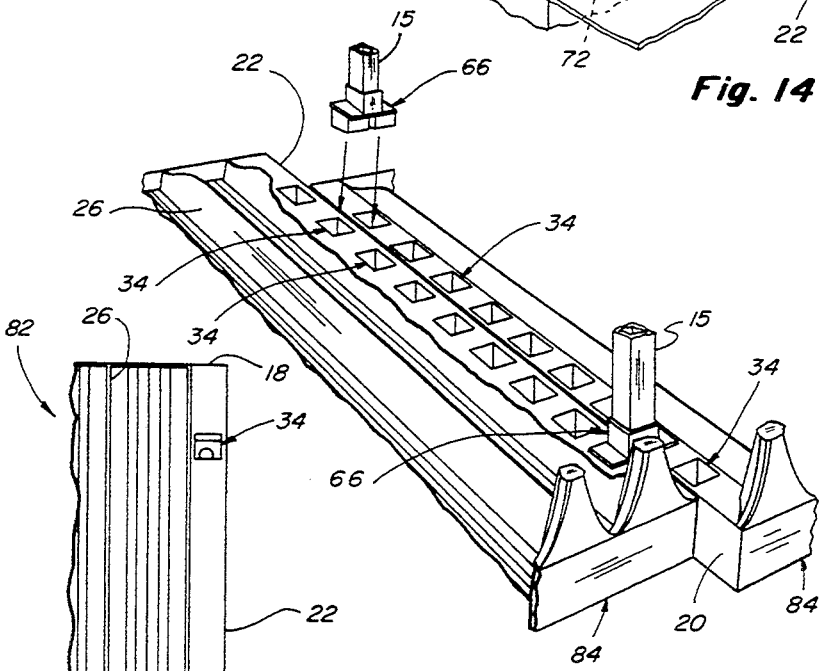
Figure 15:
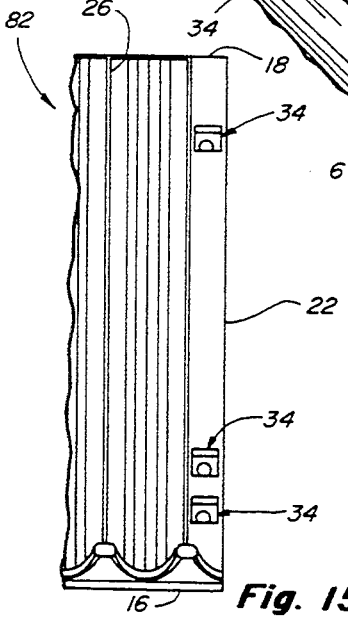
Figure 16:
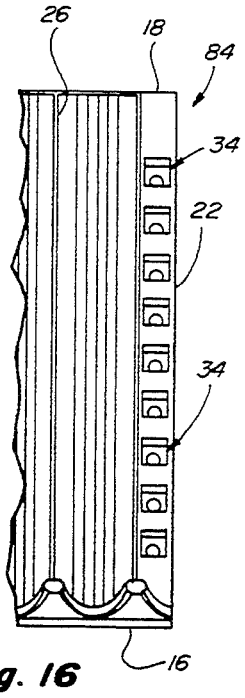

FIGS. *7a, 7b, 7c* and *7d* are partial top plan views of various embodiments of the present socket means illustrating a variety of different socket constructions for supporting the opposed end portions of the respective support members within the present socket means;

FIG. 8 is a perspective view of a plurality of the present display units arranged in modular configuration;

FIG. 9 is a perspective view of the present Y-shaped connector means utilized to achieve the modular configuration illustrated in FIG. 8;

FIG. 10 is a side elevational view of the present Y-shaped connector means;

FIG. 11 is a front elevational view of the present Y-shaped connector means;

FIG. 12 is a cross-sectional view taken along line 12—12 of FIG. 11 showing the wall construction between the upper and lower socket means;

FIG. 13 is a cross-sectional view taken along line 13—13 of FIG. 10 likewise showing the wall construction between the upper and lower socket means;

FIG. 14 is a partial perspective view showing engagement of the present Y-shaped connector means of FIGS. 9–13 with the upper and lower socket means associated with two of the shelf members shown in FIG. 8;

FIGS. 15 and 16 are partial top plan views illustrating other embodiments of the present shelf members wherein different arrays of the present socket means are utilized adjacent the opposed side wall portions of each respective shelf member; and FIG. 17 is a partial perspective view of two of the present shelf members illustrated in FIG. 16 arranged in side-by-side relationship so as to achieve a staggered modular arrangement.

DETAILED DESCRIPTION OF THE INVENTION

Figure 1:
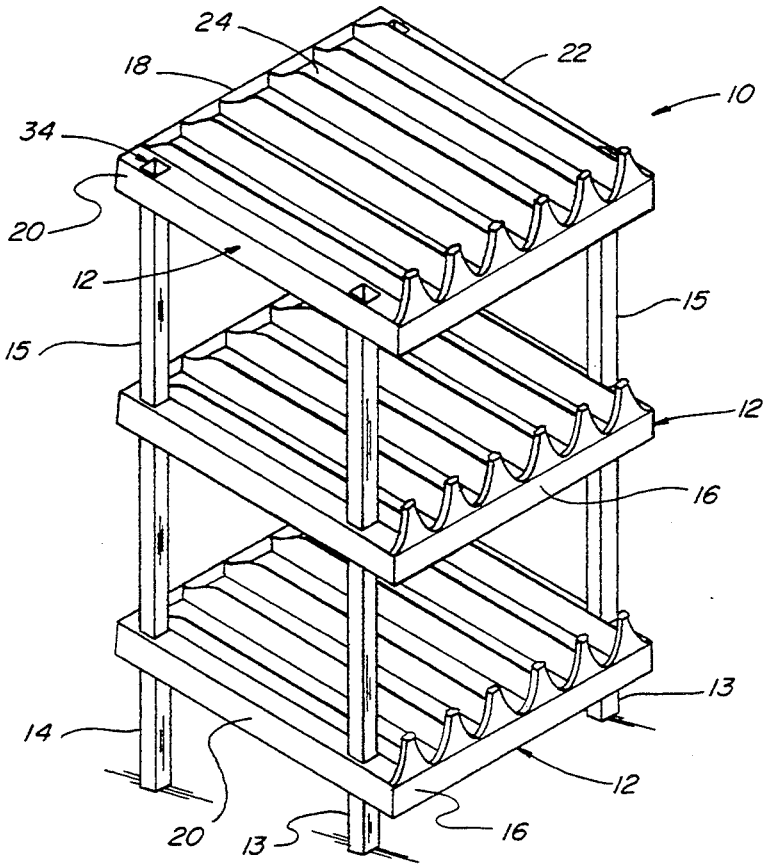
FIG. 1 is a perspective view of one embodiment of a display unit constructed according to the teachings of the present invention.
Figure 3:
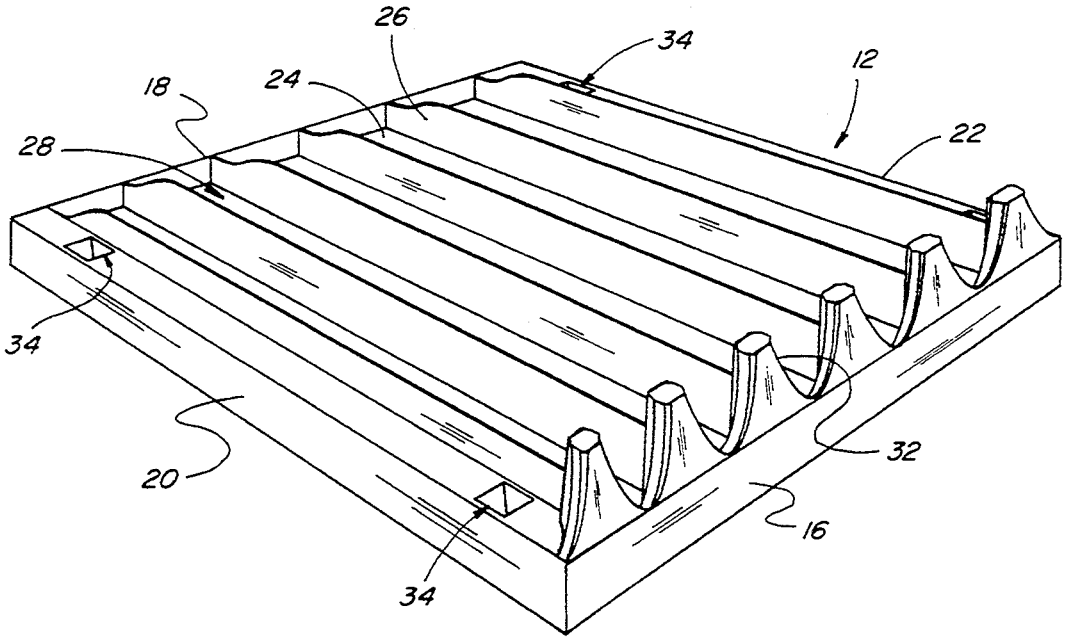
FIG. 3 is a perspective view of one of the shelf members of FIG. 1.
Figure 2:
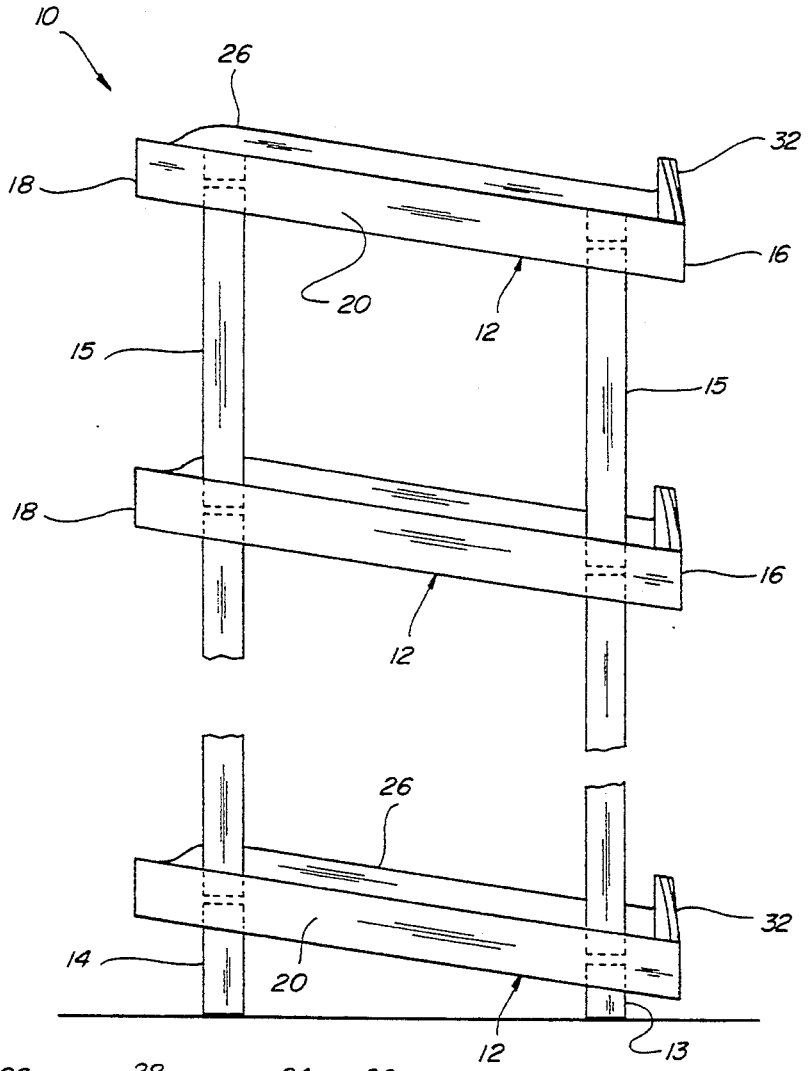
FIG. 2 is a side elevational view of the display unit of FIG. 1.
Figure 4:
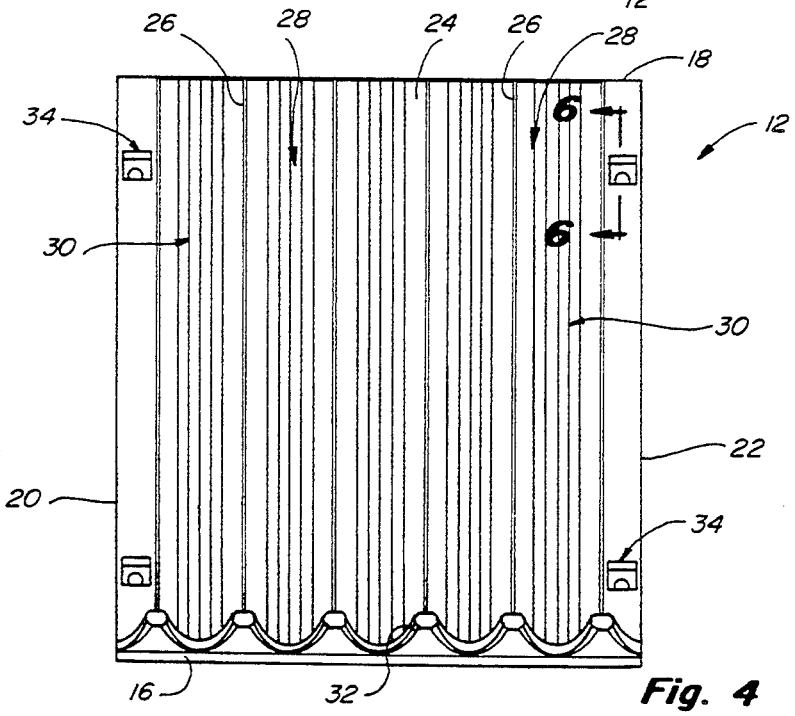
FIG. 4 is a top plan view of the shelf member of FIG. 3.

Referring to the drawings more particularly by reference numbers wherein like numerals refer to like parts, number 10 in FIGS. 1 and 2 identify a gravity feed display unit constructed according to the teachings of the present invention. The display unit 10 includes a plurality of substantially similar shelf members 12, a plurality of elongated base support members 13 and 14, and a plurality of elongated support members 15 positioned between the spaced apart shelf members 12 for vertically stacking the same one above the other as shown in FIGS. 1 and 2. Each of the shelf members 12 is designed to support and merchandise products positioned thereon such as bottled and canned soft drink products and the like, and each shelf 12 includes spaced front and rear wall portions 16 and 18, spaced side wall portions 20 and 22, and a floor portion 24 which extends substantially the full length and width of the member 12 between the front, rear and side wall portions as shown in FIGS. 3 and 4. Each shelf member 12 is generally rectangular in shape and may include a plurality of spaced upstanding wall portions or partitions 26 which extend substantially between the front and rear wall portions 16 and 18, the partitions 26 defining therebetween a plurality of parallel guide channels 28 for supporting and guiding products positioned therein in parallel rows therebetween. Although use of the divider or partition means 26 enables a merchant to more attractively arrange and organize products positioned within the respective guide channels 28 and such use is particularly advantageous in a gravity feed arrangement, it is also anticipated and recognized that the shelf members 12 may be constructed with no interior partitions whatsoever depending upon the particular application and/or the type of products merchandised therefrom. Also, importantly, depending upon the overall size of the products positioned within the respective guide channels 28, the height of the divider walls 26 may be varied to accommodate such products.

The shelf members 12 may also include track means 30 positioned in each of the respective guide channels 28, which track means 30 extend substantially between the front and rear wall portions 16 and 18 as best shown in FIG. 4. The track means 30 are preferably integrally formed into the floor structure 24 associated with each respective guide channel 28, although individual track members (not shown) such as the track members disclosed in U.S. Pat. No. 4,454,949 may likewise be adhesively or otherwise attached to the floor portion 24 within each respective guide channel 28 as described in U.S. Pat. No. 4,545,949. The track means 30 act as a support surface upon which products rest and slide, such track means being constructed and utilized so as to improve the slidability of products positioned thereon. This is accomplished by adding a slip or lubricating agent to the plastic material forming the track means 30. The actual construction of the track means 30 as well as the materials and lubricants used to improve the slidability of products positioned thereon are more fully described in U.S. Pat. Nos. 4,801,025 and 4,454,949, both of which patents were likewise issued to the present Assignee. All such disclosures relating to the construction of the various embodiments of the track means 30 in the above-identified U.S. patents are incorporated herein by reference. The use of such track means 30, although not required, greatly facilitates a gravity feed operation.

It should also be noted that the front wall 16 of each shelf member 12 is formed to include a plurality of inverted arches 32 as clearly shown in FIGS. 1, 3 and 4. The inverted arches 32 are uniformly disposed across the length of the front-wall 16 and are positioned respectively adjacent to the front end of each respective guide channel 28. Besides enhancing the aesthetic appearance of the display unit 10, the arches 32 serve as stop means for holding and retaining products positioned within the respective channels 28 until such products are removed therefrom. It is also recognized and anticipated that any suitable form of stop means may be utilized across the front portion of each respective shelf member 12 so as to hold and retain products positioned thereon in a gravity feed orientation prior to customer removal. Still further, it is also recognized that the shelf members 12 may be fashioned into a variety of different sizes and shapes, for example, a square, circular, hexagonal, or some other configuration, without impairing the teachings and practice of the present invention so long as such members are capable of being stackably arranged in spaced apart relationship one above the other through the use of the support members 13, 14 and 15 as will be hereinafter explained.

Figure 5:
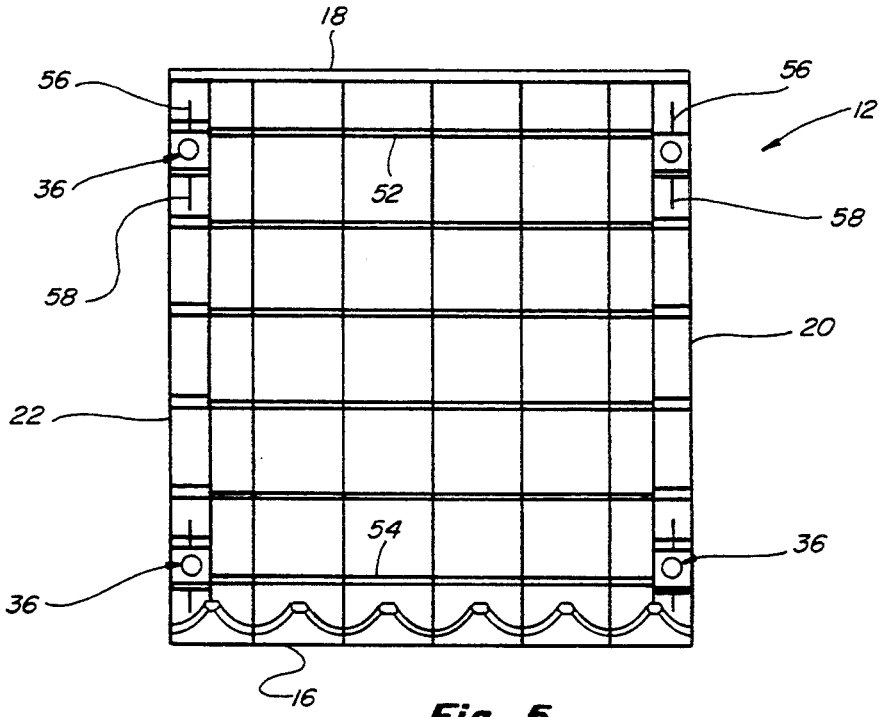
FIG. 5 is a bottom view of the shelf member of FIG. 3.

Importantly, each shelf member 12 includes a plurality of upper socket or receptacle means 34 positioned and located adjacent the respective side wall portions 20 and 22 as best shown in FIGS. 3 and 4, and a plurality of corresponding lower socket or receptacle means 36 as best shown in FIG. 5. Although the shelf member illustrated in FIGS. 1–5 disclose the use of only two socket means 34 and 36 associated with each respective side portion of the shelf member 12, as will be hereinafter further explained, any number of socket means may be positioned and located adjacent each respective side wall portion of each shelf member 12 depending upon the particular use and/or application desired. Each socket means 34 and 36 includes a respective cavity 38 and 40, each cavity 38 and 40 being specifically configured for receiving and engaging a correspondingly shaped end portion associated with the support members 13–15.

Figure 6:
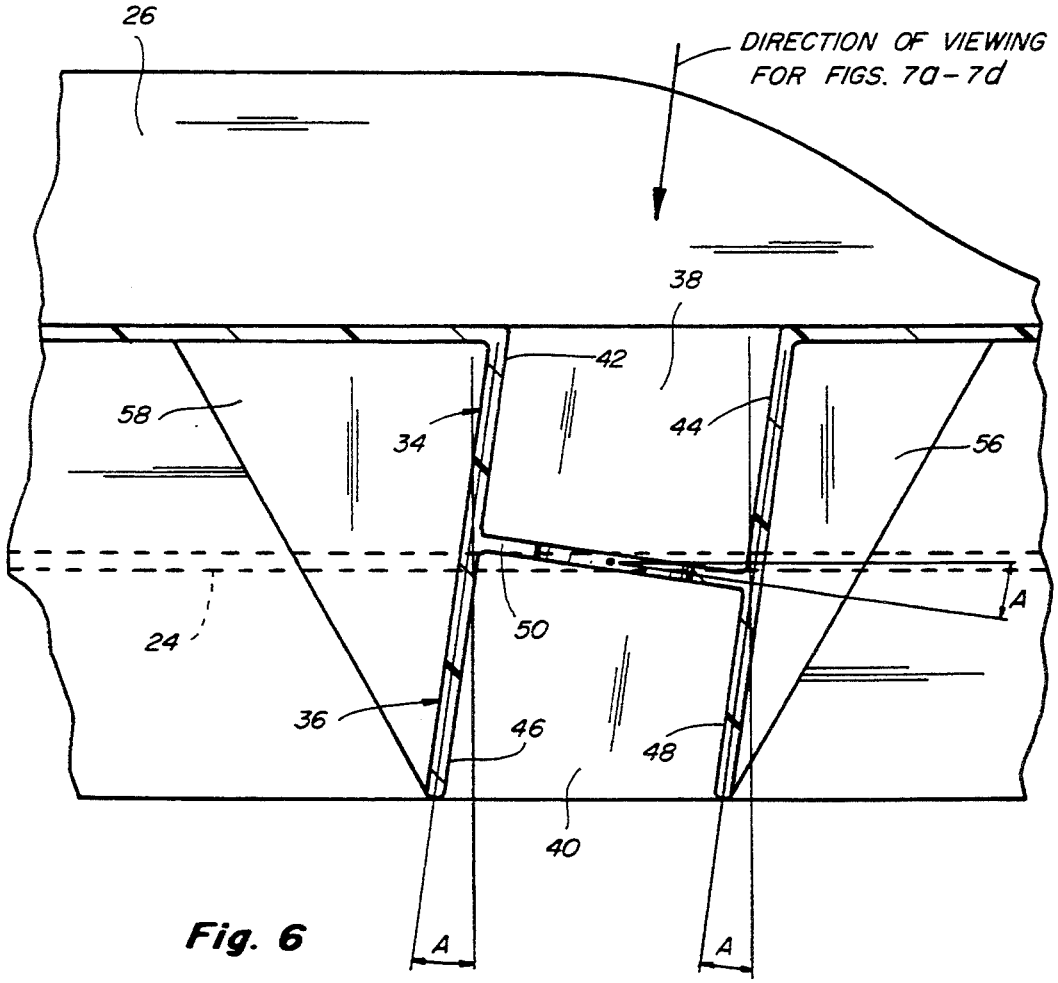
FIG. 6 is a partial side cross-sectional view taken along line 6—6 of FIG. 4 showing the wall construction of the present socket means.
Figure 7A:
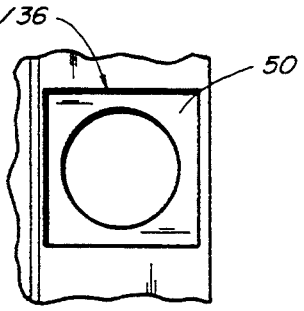
Figure 7C:
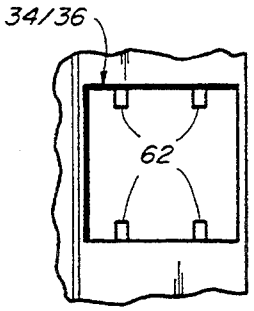
Figure 7B:
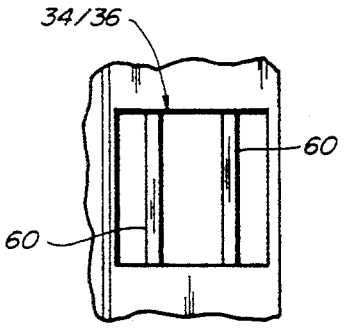
Figure 7D:
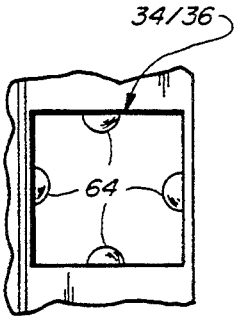

As best illustrated in FIG. 6, the upper and lower socket means 34 and 36 are preferably axially positioned in alignment with each other such that each pair of upper and lower socket means 34 and 36 are positioned one above the other as illustrated. Although the axial arrangement of the respective socket means is preferred from a manufacturing standpoint, this arrangement is not mandatory and the upper and lower socket means 34 and 36 can be arranged in a non-aligned orientation with respect to each other if so desired. However, regardless of the orientation or alignment of the upper and lower socket means with respect to each other, each socket cavity 38 and 40 includes side wall portions such as the fore and aft side wall portions 42 and 44 associated with socket means 34 and the fore and aft side wall portions 46 and 48 associated with lower socket means 36 (FIG. 6) which form locating surfaces for positioning and locating the opposed end portions of the respective support members 13–15 within each such cavity. Importantly, the cavity side wall portions 42–48 are each respectively angularly oriented at the same acute angle relative to the vertical as illustrated by the angles A in FIG. 6 such that when the cavity wall surfaces 42–48 are vertically oriented relative to a horizontal surface, the floor portion 24 of each shelf member is angularly oriented as illustrated in FIGS. 1 and 2, sloping from a more elevated position at the rear of the shelf to a less elevated position at the front thereof. In this regard, when the support members 13–15 are engaged with their respective socket means 34 and 36 and the assembled unit 10 is supported on a substantially horizontal support surface as shown in FIGS. 1 and 2, each individual shelf member 12 will be supported in an inclined gravity feed position and the angle of inclination of the shelf floor 24 relative to the horizontal will be equal to the angle A. Also, the inclination of the shelf floor 24 is such that when rolls of products are positioned thereupon, they will slide under the force of gravity towards the front wall 16 of the members 12 for easy access and removable by customers.

As explained in U.S. Pat. Nos. 4,416,380 and 4,454,949, it has been found that a floor or track inclination of between about 7° to 8° provides a desirable condition such that when one of the up-front products is removed, the remaining products positioned therebehind will automatically slide along the respective track means or floor portion in a smooth and steady manner and without toppling over. It has also been found that track or floor inclinations in the range from about 3° to about 11° also provides suitable results for some applications depending upon the particular types of goods being merchandised therefrom. The socket means 34 and 36 are therefore respectively integrally formed into the respective side wall portions of each shelf member 12 so as to produce the desired shelf floor inclination as described above.

It should also be noted that the upper and lower cavities 38 and 40 are seperated by an intermediate wall portion 50 which extends therebetween as best shown in FIGS. 6 and *7a*. The wall portion 50 forms a bearing surface for engaging the respective end portions of the support members 13–15 when such members are insertably positioned within the respective cavities 38 and 40 and its thickness can be varied depending upon the weight capacity of the particular goods to be stackably arranged upon the individual shelf members 12. The bearing wall 50 is likewise angularly oriented at the same acute angle A relative to the plane of the floor portion 24 and provides adequate support and stability to the uppermost shelves 12 in any particular array. The support members 13–15 are each constructed such that either end portion thereof may be engaged with anyone of the respective socket cavities 38 and 40.

As previously indicated, the socket means 34 and 36 are integrally formed with the respective side wall portions of each shelf member 12 so as to improve upon the rigidity and stability of any multi-tiered display system erected utilizing the present shelf members 12. Also, integration of the socket means 34 and 36 directly into the opposed side wall portions 20 and 22 of each respective shelf member 12 enables the manufacturer to utilize the underside gridwork structure of such units as illustrated in FIG. 5 so as to provide still additional strength and support to both the overall shelf member as well as to each pair of opposed socket means. In this regard, the transverse rib members 52 and 54 (FIG. 5) not only provide added support, stability and rigidity to the overall shelf member 12, but they likewise reinforce and provide added load carrying strength to each pair of opposed socket means, particularly when a plurality of such shelf members 12 are vertically stackably arranged one upon the other to form a multi-tiered structure. Additional reinforcing rib members such as the rib members 56 and 58 (FIG. 5) may likewise be added, if neccessary, to add further support, stability and rigidity to each socket means. Even if the socket means 34 and 36 are arranged in a non-aligned orientation with respect to each other as previously described, the underside gridwork structure of each shelf member 12 can still be utilized to provide additional strength and reinforcement to the individual socket means regardless of their particular arrangement. This is certainly an improvement over certain prior art constructions of Applicant disclosed in U.S. Pat. No. 4,763,796.

FIGS. *7b*, *7c* and *7d* illustrate still other bearing support means which may be utilized within the respective socket cavities 38 and 40 in place of the intermediate bearing wall portion 50. FIGS. *7a*, *7b*, *7c* and *7d* all represent partial top plan views looking directly into a representative socket means 34 or 36 along the direction of the viewing arrow set forth in FIG. 6. More particularly, unlike the socket construction illustrated in FIGS. 6 and *7a*, FIG. *7b* illustrates the use of any number of rod-like members 60 extending completely across the socket cavity space; FIG. *7c* illustrates the use of any number of short projections 62 extending inwardly into the socket cavity space from at least some of the side wall portions forming the cavity wall; and FIG. *7d* represents the use of any number of relative small nipples or bumps 64 which likewise extend inwardly into the socket cavity space from at least some of the side wall portions forming the cavity wall. Like the intermediate bearing surface 50, it is preferred that the bearing support means 60, 62 and 64 be likewise angularly oriented within the respective cavity space on a plane which is at the same acute angle A as the bearing surface 50 is relative to the plane of the shelf floor 24 (FIG. 6). It is also recognized that the members 60, 62 and 64 can likewise extend from any one or more of the remaining side wall portions forming the respective socket cavities. Also, importantly, it is anticipated that any other suitable means for providing a suitable bearing surface for supporting and engaging the respective end portions of the support members 13–15 when such members are insertably positioned within the respective socket cavities 38 and 40 can likewise be utilized.

Referring to FIGS. 1 and 2, stackably arranging one shelf member 12 above another in spaced relationship is accomplished by insertably engaging one end portion of the support members 13 and 14 with the respective lower socket cavities 40 located on the first lowermost shelf member 12 and thereafter supporting the members 13 and 14 on a suitable support surface. It is important to note that the support members 13 are engaged with the forwardmost socket means 36 while the support members 14 are engaged with the rearwardmost socket means 36 as best shown in FIG. 2. Since the support members 14 are greater in length than the members 13 as can be seen from the illustration in FIGS. 1 and 2, this arrangement will support the first shelf member 12 in an inclined gravity feed position. One end portion of a second set of support members 15 are subsequently insertably engaged with the upper socket cavities 34 of the first shelf member 12 and each extends upwardly therefrom in position to receive the lower socket cavities associated with the next shelf member 12 to be positioned thereabove. Accordingly, the opposite end portions of the support members 15 are respectively engaged with the upper socket cavities associated with one shelf member and the lower socket cavities associated with another shelf member positioned thereabove. This stacking process may be continued to achieve any desired number of vertically disposed shelf members 12 and/or any desired shelf height.

It is also important to note that all of the elongated support members 13–15 utilized in the display unit 10 are identical in construction to each other except for the base support members 13 and 14 which differ from the members 15 in length only. The rear support members 14 must be greater in length than the front support members 13 in order to acheive the proper inclination of the first shelf member 12 for a gravity feed operation. The difference in overall length between the support members 13 and 14 should be such that when the support members 13 and 14 are engaged with a first shelf member 12 and supported on a substantially horizontal surface, such first shelf member 12 is inclined at the desired shelf inclination for a gravity feed operation. The inclination achieved by the differences in length between the members 13 and 14 should be in conformity with the shelf inclinations achieved by the angular positioning of the respective socket means 34 and 36 associated with each shelf member 12.

It is also recognized that various other means for cooperatively engaging the opposite end portions of the support members 13–15 to the shelf socket means 34 and 36 may likewise be utilized without departing from the teachings and practice of the present invention. For example, as disclosed and more fully described with respect to the socket construction illustrated in FIG. 4 of U.S. Pat. No. 4,763,796, the opposite end portions of the various support members 13–15 may cooperatively engage or telescope over a projection member or other locating wall means associated with each socket means 34 and 36. In this situation, the respective end portions of each support member would include an opening or a cavity shaped to receive and engage the respective projection members as illustrated in U.S. Patent No. 4,763,796. Also, in this particular arrangement, the wall means forming each respective projection member would be angularly oriented at the same acute angle A relative to the vertical as the cavity side wall portions 42–48 illustrated in FIG. 6 such that when such projection members are vertically oriented relative to a horizontal surface, the floor portion 24 of each of the present shelf members would again be angularly oriented in an inclined gravity feed orientation as previously described. It is further recognized and anticipated that still other suitable means for cooperatively engaging the respective end portions of the support members 13–15 with the corresponding shelf socket means 34 and 36 may likewise be utilized.

FIG. 8 illustrates one modular arrangement of the present display unit 10. The modular capability of the present invention is achieved through the use of connector means 66 illustrated in FIGS. 9–13. Each connector means 66 is substantially Y-shaped in structure and each includes a double socket arrangement such as the socket means 68 and 70 associated with one end portion thereof and a single socket arrangement such as the socket means 72 associated with the opposite end portion thereof. The connector socket means 68 and 70 are identical in structure and each includes a cavity 74 which is correspondingly shaped and dimensioned to cooperatively engage any one of the socket means 34 and 36 located on both the upper and lower surfaces respectively of each shelf member 12. The connector socket means 68 and 70 are insertably receivable within the respective shelf socket means 34 and 36 and form a tight frictional fit therewith. The connector socket means 68 and 70 are likewise preferably dimensioned depthwise so as to correspond to the depth of the socket cavities 38 and 40. Similarly, the single connector socket means 72 includes a cavity 76 which is correspondingly shaped and dimensioned so as to telescopingly receive either end portion of the respective support members 13–15 as best shown in FIGS. 8 and 17.

Importantly, the connector means 66 is specifically constructed so as to be compatible with the shelf socket means 34 and 36 when engaged therewith such that when the upright support members 13–15 are engaged with the single connector socket means 72 and the assembled units 10 are supported on a substantially horizontal support surface as shown in FIG. 8, each individual shelf member 12 engaged with the connector means 66 will likewise be supported at the same inclined gravity feed orientation as the other shelf members 12 utilized in the assembled display. This relationship is achieved by angularly orienting the wall portion 78 seperating the double socket connector means 68 and 70 from the single socket connector means 72 as best shown in FIGS. 9, 10 and 12. The connector wall portion 78 is therefore angularly oriented relative to the horizontal at the same acute angle as the bearing wall surface 50 associated with the respective shelf socket means 34 and 36. This same angular orientation likewise corresponds to the same angular orientation associated with the cavity side wall portions 42–48 such that when the connector socket means 68 and 70 are positioned within any one of the shelf socket means 34 and 36, the peripheral edge portions of the connector wall portion 78 will abut and lie flush with the respective distal edge portions of the shelf socket means 34 and 36 along the periphery thereof as best shown in FIG. 14. This properly orients the connector means 66 relative to the socket means 34 and 36 and also relative to the upper and lower surfaces of the shelf side portions 20 and 22 so as to impart the same angular orientation to the shelf members 12 when the connector means 66 are used in conjunction therewith. The angle of inclination associated with the connector wall portion 78 therefore corresponds to the angle of inclination imparted to a particular shelf member when any one of the elongated support members 13–15 are engaged with the shelf socket means 34 and 36.

Also, the connector socket means 72 may likewise optionally include a pair of wedge-shaped members 80 positioned respectively adjacent the opposed side wall portions forming the connector socket means 72 as best shown in FIGS. 10, 12 and 13, the lower surface portions of such wedge-shaped members 80 lying in abutment with the connector wall portion 78 and the upper surface portions thereof forming a horizontal abutment surface for engaging either end portion of the support members 13–15 when positioned within the socket cavity 76. These wedge-shaped members 80 provide more of a bearing surface for the respective end portions of the support members such that the distal or terminal end portions of such members will mate with and abut the upper surface of the members 80 along their entire length. This helps to better support and more evenly distribute the weight/load distribution associated with a fully loaded display unit. It is also recognized and anticipated that other means including a horizontal floor portion integrally formed within the socket cavity 76 could likewise be utilized so as to provide a bearing surface which engages the entire distal end portion of the support member positioned therewithin. Still further, it is also recognized and anticipated that the present connector means 66 can be manufactured both as an independent connector member as shown in FIGS. 9–13, and the connector means 66 can likewise be formed integral with one or both end portions of the support members 13–15.

FIGS. 8 and 14 illustrate how the present connector means 66 can be utilized in conjunction with the shelf members 12 to achieve a modular arrangement. As is apparent from FIGS. 8 and 14, the connector means 66 can be utilized to achieve any side-by-side modular configuration including various offset or staggered arrangements as will be hereinafter discussed with respect to FIGS. 15–17 as well as arrangements having portions thereof of varying height so as to accommodate any particular display application. Use of the connector means 66 enables a user to modularly arrange a particular display based upon the particular floor space available thereby giving the user greater flexibility in conserving and efficiently utilizing any particular merchandising area while at the same time stablely connecting all of the various shelf members associated with such display arrangement. FIG. 14 shows in detail how the connector means 66 engage the respective upper and lower socket means associated with two adjacent shelf members 12. As previously described, the angularly oriented connector wall portion 78 mates flush with the upper and lower surfaces of the respective side wall portions of the shelf members 12 thereby enabling the same angle of inclination to be imparted to the particular shelf members engaged therewith as would be imparted to the members 12 if the connector means 66 were not utilized. Also, importantly, the present connector means 66 are constructed such that engagement of such connector means 66 with both the upper and lower shelf socket means 34 and 36 will produce vertically aligned upright support members 13–15 as shown in FIG. 8.

FIGS. 15 and 16 illustrate two additional embodiments 82 and 84 of the present shelf member 12. The shelf members 82 and 84 are substantially similar in construction and operation to the shelf member 12 and differ therefrom only in the total number of socket means 34 and 36 associated with the respective side wall portions thereof. For example, shelf member 82 illustrated in part in FIG. 15 discloses the use of a set of two socket means 34 and 36 positioned adjacent the respective side wall portions of the member 82 towards the front portion thereof and only a single socket arrangement positioned towards the rear thereof. In contrast, the shelf member 84 illustrated in part in FIG. 16 discloses the use of a plurality of socket means 34 and 36 associated with each respective side portion of the unit, the present socket means being arranged in a linearly aligned array between the respective front and rear wall portions of the unit. Besides the particular socket arrangements illustrated in FIGS. 15 and 16, it is also recognized and anticipated that any number of socket means 34 and 36 can be positioned and arranged adjacent each side portion of the present shelf members. It is also recognized and anticipated that the spacing between each respective socket means 34 and 36 can likewise be varied depending upon the particular application desired. Use of a plurality of socket means adjacent each respective side portion of the present shelf member provides greater capability in that it allows a user to strategically position the upright support members inwardly from the respective corners of each shelf member so as to improve product visibility and customer accessibility. Such a socket arrangement also enables a user to utilize more than two support members 13–15 adjacent any particular shelf side portion depending upon the weight/load distribution of the products merchandised therefrom.

It is also obvious that the use of a plurality of socket means adjacent the respective shelf side portions significantly expands the modular capability of such shelf members as illustrated in FIG. 17. FIG. 17 illustrates how two of the shelf members 84 may be utilized in conjunction with the present connector means 66 to achieve an offset or staggered modular arrangement. Here again, the shelf members 82 and 84 can be arranged to produce any multiplicity of side-by-side gravity feed modular arrangements including various offsets and/or staggered arrangements so as to form a structurally integral and unitized system as illustrated in FIG. 8. The present shelf members therefore provide a merchant with a greater range of possibilities for utilizing a gravity feed type arrangement when displaying goods to the consuming public and they provide a merchant with a greater range of possibilities for maximizing adjacent positioning of any plurality of such shelf members by providing a multitude of alternative modular configurations.

It is also important to note that the overall dimensions of the present unit 10 as well as the particular dimensions and configuration of the present shelf members 12, 82 and 84, the support members 13–15, the shelf socket means 34 and 36, and the connector means 66 are subject to wide variations and each of the members associated with the various embodiments of the present display unit may be sized and shaped into a variety of different sizes and configurations to accommodate different display applications, different product sizes and shapes, and to conform with any space limitations without impairing the teachings and practice of the present invention. It is also recognized and anticipated that a wide variety of different header assemblies may be used in conjunction with all of the various embodiments of the present display unit including those illustrated in FIGS. 1 and 8 to attractively advertise and focus attention upon the specific products on display within such units. In this regard, any form of signage can be attached to the front, back or all sides of any particular embodiment of the present display unit and, with respect to the various modular arrangements of the present invention such as the one illustrated in FIG. 8, such header signage can be achieved through utilization of both the angular shelf socket means 34 and 36 and the connector means 66. Although the present shelf members have particular utility in a merchandising environment for storing and merchandising a multiplicity of shelved products therefrom, its simplicity, durability, flexibility and versatility greatly increases its usefulness and effectiveness in a wide variety of other applications.

Thus, there has been shown and described several embodiments of a display unit construction having modular capability, which display unit fulfills all of the objects and advantages sought therefor. Many changes, modifications, variations and other uses and applications of the present constructions will, however, become apparent to those skilled in the art after considering this specification and the accompanying drawings. All such changes, modifications, variations and other uses and applications which do not depart from the spirit and scope of the invention are deemed to be covered by the invention which is limited only by the claims which follow.

What is claimed is:

1. A display unit for vertically stackably arranging products in an inclined gravity feed orientation comprising a plurality of substantially similar shelf members each having opposed front and rear portions, opposed side wall portions and a floor portion extending therebetween for positioning products thereon, each of said opposed side wall portions having a portion extending above said floor portion and each having a portion extending below said floor portion, a plurality of elongated support members each having opposed end portions, a plurality of cooperatively engageable means integrally formed with the upper portion of each of said opposed side wall portions and a plurality of cooperatively engageable means integrally formed with the lower portion of each of said opposed side wall portions, said plurality of upper and lower cooperatively engageable means being positioned at spaced locations on the respective upper and lower portions of said opposed side wall portions so as to extend laterally inwardly towards said floor portion and away from the peripheral edge of each of said side wall portions, each of said plurality of upper and lower cooperatively engageable means including wall means for positioning and locating the opposed end portions of said support members relative to each of said cooperatively engageable means, the wall means associated with each of said upper and lower cooperatively engageable means being angularly oriented at the same acute angle relative to the vertical such that when a plurality of said elongated support members are engaged with a plurality of said upper and lower cooperatively engageable means on adjacent shelf members to connect said adjacent shelf members in spaced apart relationship one above the other, the floor portion of each of said shelf members will be angularly oriented in a gravity feed orientation relative to a horizontal surface when said elongated support members are vertically oriented relative to the same horizontal surface, and means for supporting said connected shelf members on the horizontal surface with said support members oriented in a vertical direction with respect thereto, each of said upper and lower cooperatively engageable .means further including means forming a bearing surface for engaging the respective end portions of said elongated support members when said support members are engaged with said cooperatively engageable means.

2. The display unit defined in claim 1 wherein said upper and lower cooperatively engageable means are positioned in axial alignment with each other.

3. The display unit defined in claim 1 wherein said bearing surface means includes floor means associated with each of said upper and lower cooperatively engageable means.

4. The display unit defined in claim 1 wherein each of said bearing surface means is angularly oriented on a plane which is at the same acute angle relative to said shelf floor portion as the wall means associated with said upper and lower cooperatively engageable means are angularly oriented relative to the vertical.

5. The display unit defined in claim 1 wherein each of said shelf members includes means integrally formed therewith for providing additional strength and rigidity to each of said plurality of cooperatively engageable means.

6. The display unit defined in claim 1 wherein said plurality of upper and lower cooperatively engageable means positioned at spaced locations on the respective upper and lower portions of said opposed side wall portions includes at least three upper cooperatively engageable means and at least three lower cooperatively engageable means, said upper and lower cooperatively engageable means being arranged in a linearly aligned array extending respectively between the front and rear portions of each of said shelf members.

7. A shelf member for use in a gravity feed display unit having one or more of said shelf members vertically arranged in spaced apart relationship one above the other and having a plurality of support members disposed therebetween connecting vertically spaced pairs of said shelf members, said shelf member comprising a member having opposed side wall portions and a planar floor portion extending therebetween, each of said opposed side wall portions having a portion extending above said floor portion and each having a portion extending below said floor portion, a plurality of socket means integrally formed with the upper and lower portions of each of said opposed side wall portions, said plurality of upper and lower socket means being positioned at spaced locations on the respective upper and lower portions of said opposed side wall portions so as to extend laterally inwardly towards said floor portion and away from the peripheral edge of each of said side wall portions, each of said plurality of upper and lower socket means being cooperatively engageable with the opposed end portions of the support members and each including side wall portions forming a cavity therewithin for locating and cooperatively engaging the opposed end portions of the support members within each of said socket means, each of said socket cavities having at least some of its side wall portions angularly oriented at the same acute angle relative to the vertical such that when a plurality of the elongated support members are engaged with a plurality of said upper and lower socket means on a pair of shelf members to connect said pair of shelf members in spaced apart relationship one above the other, the floor portion of each of said pair of shelf members will be angularly oriented in a gravity feed orientation relative to a horizontal surface when the support members are vertically oriented relative to the same horizontal surface, each of said upper and lower socket means further including means within each socket cavity forming a bearing surface for engaging the respective end portions of the support members when the support members are insertably positioned within said socket cavities, said bearing surface means being angularly oriented on a plane which is at the same acute angle relative to the shelf floor portion as at least some of the shelf socket cavity side wall portions are angularly oriented relative to the vertical.

8. The display unit defined in claim 1 wherein the upper and lower cooperatively engageable means associated with one of the side wall portions of each of said shelf members are respectively arranged in opposed relationship to the upper and lower cooperatively engageable means associated with the other opposed side wall portion of each of said shelf members.

9. The display unit defined in claim 1 wherein said means for supporting said connected shelf members on a horizontal surface includes a plurality of base support members engageable with at least some of the lower cooperatively engageable means associated with the lowermost shelf member of said plurality of connected shelf members, said base support members being dimensioned so as to maintain said connected shelf members in parallel inclined gravity feed orientation.

10. The display unit defined in claim 1 including connector means for joining two of said shelf members in side-by-side gravity feed relationship to each other, said connector means having opposed end portions including a pair of socket means associated with one end portion thereof and a single socket means associated with the opposite end portion thereof, each of said pair of connector socket means being correspondingly shaped and dimensioned so as to be insertably receivable within any one of said plurality of upper and lower cooperatively engageable means associated with the opposed side wall portions of each of said shelf members, said single connector socket means having a cavity associated therewith correspondingly shaped and dimensioned to telescopingly receive the opposed end portions of each of said elongated support members, said connector means further including means to properly orient said connector means relative to the upper and lower cooperatively engageable means of said shelf side wall portions thereby enabling said connector means to impart the same angular orientation to the planar floor portion of each of said shelf members as said upper and lower cooperatively engageable means when said connector means are utilized in conjunction with said upper and lower cooperatively engageable means and said elongated support members.

11. The display unit defined in claim 10 wherein said means to properly orient said connector means relative to the upper and lower cooperatively engageable means of said shelf side wall portions includes a wall portion separating the pair of connector socket means associated with one end portion of said connector means from the single connector socket means associated with the opposite end portion thereof, said connector wall portion being angularly oriented relative to the horizontal at the same acute angle as the wall means associated with each of said upper and lower cooperatively engageable means are angularly oriented relative to the vertical.

12. A display unit for accommodating the storage of products positioned thereon in a gravity feed orientation comprising a plurality of substantially similar shelf members each having an upper and a lower portion and a floor portion extending therebetween, a plurality of elongated support members having opposed end portions, a plurality of socket means formed integral with the upper portion of each of said shelf members and a plurality of socket means formed integral with the lower portion of each of said shelf members, said plurality of upper and lower socket means being positioned at spaced locations on the respective upper and lower portions of said shelf members such that no portion of said shelf socket means extend beyond the peripheral edge portions of said shelf members, each of said shelf socket means being cooperatively engageable with the opposed end portions of said elongated support members and each including wall means angularly oriented at the same acute angle relative to the vertical, said plurality of upper and lower shelf socket means imparting a gravity feed inclination to the floor portion associated with each of said shelf members when said support members are engaged with adjacent shelf members and said elongated support members are thereafter vertically oriented relative to a horizontal surface, means for supporting said connected shelf members on a horizontal surface with said support members oriented in a vertical direction with respect thereto, connector means for joining at least two of said shelf members in side-by-side gravity feed relationship one adjacent the other, said connector means having opposed end portions and including a pair of socket means associated with one end portion thereof and a single socket means associated with the opposite end portion thereof, each of said pair of connector socket means being cooperatively receivable within any one of said plurality of socket means associated with the upper and lower portions of each of said shelf members, said single connector socket means being correspondingly shaped and dimensioned so as to cooperatively receive one of the opposed end portions of each of said elongated support members, said connector means further including wall means positioned intermediate said pair of connector socket means and said single connector socket means, said connector wall means being angularly oriented relative to the horizontal at the same acute angle as the shelf socket wall means are angularly oriented relative to the vertical, said angularly oriented connector wall means enabling said connector means to be properly oriented relative to said plurality of upper and lower shelf socket means when said pair of connector socket means are engaged therewith thereby enabling said connector means to impart the same angular orientation to the floor portion of each of said shelf members when said connector means are utilized in conjunction therewith and said elongated support members are vertically oriented relative to a horizontal surface, the angular orientation of said connector wall means further enabling the peripheral edge portions thereof to lie flush with and abut the respective distal edge portions of said upper and lower shelf socket means when engaged therewith, said plurality of elongated support members and said connector means being positioned and arranged so as to engage at least some of the upper and lower socket means associated with at least two shelf members to permit said shelf members to be vertically stackably arranged in spaced apart gravity feed relationship one above the other and to be alternatively arranged in side-by-side gravity feed relationship one adjacent the other.

13. The display unit defined in claim 12 wherein said means for supporting said connected shelf members on a horizontal surface includes a plurality of base support members engageable with at least some of the lower socket means associated with all of the lowermost shelf members of said plurality of connected shelf members, said base support members being dimensioned so as to maintain all of said plurality of support members connected to said shelf members in a substantially vertical orientation.

14. The display unit defined in claim 12 wherein the single connector socket means associated with one end portion of said connector means is formed integral with at least one of the opposed end portions of at least some of said elongated support members.

15. In a gravity feed display unit having a plurality of shelf members vertically assembled in spaced apart relationship one above the other, a plurality of elongated support members connecting vertically spaced pairs of said shelf members, each shelf member having a floor portion and upper and lower engagement means for cooperatively engaging the opposed end portions of said support members, said plurality of upper and lower shelf engagement means including bearing surface means oriented at an acute angle relative to the plane of said shelf floor portion for imparting a gravity feed inclination to each of said shelf members when said support members are engaged with a plurality of upper and lower shelf engagement means and said elongated support members are thereafter vertically oriented relative to a horizontal surface, the improvement comprising connector means for joining at least two of said shelf members in side-by-side gravity feed relationship one adjacent the other, said connector means having opposed end portions and including a pair of engagement means associated with one end portion thereof and a single engagement means associated with the opposite end portion thereof, each of said pair of connector engagement means being cooperatively engageable with any one of said plurality of upper and lower shelf engagement means associated with each of said shelf members, said single connector engagement means being correspondingly shaped and dimensioned so as to cooperatively engage one of the opposed end portions of each of said elongated support members, said connector means further including a wall portion separating said pair of connector engagement means from said single connector engagement means, said connector wall portion being angularly oriented relative to the horizontal at the same acute angle as the bearing surface means associated with each of said shelf engagement means, said angularly oriented connector wall portion enabling said connector means to be properly oriented relative to said plurality of upper and lower shelf engagement means when said pair of connector engagement means are engaged therewith thereby enabling said connector means to impart the same angular orientation to each of said shelf members when said connector means are utilized in said vertically assembled display unit and said elongated support members are vertically oriented relative to a horizontal surface.

* * * * *

UNITED STATES PATENT AND TRADEMARK OFFICE

CERTIFICATE OF CORRECTION

PATENT NO. : 5,417,333
DATED : May 23, 1995
INVENTOR(S) : Paul L. Flum

It is certified that error appears in the above-indentified patent and that said Letters Patent is hereby corrected as shown below:

Column 6, line 56, "front-wall" should be --front wall--.

Column 14, line 28, ".means" should be --means--.

Signed and Sealed this

First Day of August, 1995

Bruce Lehman

*Attest:*

BRUCE LEHMAN

*Attesting Officer*

*Commissioner of Patents and Trademarks*